US005333855A

United States Patent [19]

Silin et al.

[11] Patent Number: 5,333,855

[45] Date of Patent: Aug. 2, 1994

[54] BASEBALL PITCHING ANALYZER

[75] Inventors: Connie J. Silin, 326 E. Bridlespur Dr., Kansas City, Mo. 64114; David E. Fowler, Overland Park, Kans.

[73] Assignee: Connie J. Silin, Kansas City, Mo.

[21] Appl. No.: 916,514

[22] Filed: Jul. 20, 1992

[51] Int. Cl.[5] ..... A63B 69/40

[52] U.S. Cl. ..... 273/26 A

[58] Field of Search ..... 273/26 R, 371, 185 R; 250/221, 222, 222.1

[56] References Cited

U.S. PATENT DOCUMENTS

| | | | |
|---|---|---|---|
| 2,113,899 | 4/1938 | Oram | 273/371 |
| 2,992,002 | 7/1961 | Bingham, Jr. | 273/26 A |
| 3,229,975 | 1/1966 | Tompkins et al. | 273/371 |
| 3,727,069 | 4/1976 | Crittenden | 273/371 |
| 3,746,862 | 7/1973 | Pronovost | 250/221 |
| 3,814,438 | 6/1974 | Baron | 273/176 FA |
| 4,198,623 | 4/1980 | Misek | 250/221 |
| 4,497,485 | 2/1985 | Macosko | 273/26 A |
| 4,553,751 | 11/1985 | Ketchum | 273/26 A |
| 4,563,005 | 1/1986 | Hand | 273/371 |
| 4,650,990 | 3/1987 | Jonsson | 250/221 |
| 4,657,250 | 5/1987 | Newland | 273/26 A |
| 4,743,020 | 5/1988 | Meurer | 273/26 A |
| 4,763,903 | 8/1988 | Goodwin | 273/371 |
| 4,861,027 | 8/1989 | Thaxton | 273/26 A |
| 4,949,972 | 8/1990 | Goodwin et al. . | |
| 5,067,718 | 11/1991 | Knox et al. | 273/185 R |
| 5,133,548 | 7/1992 | Bedord, II | 273/26 A |

FOREIGN PATENT DOCUMENTS

| | | | |
|---|---|---|---|
| 48010 | 10/1980 | Switzerland | 273/371 |

*Primary Examiner*—Theatrice Brown

*Attorney, Agent, or Firm*—Kokjer, Kircher, Bowman & Johnson

[57] ABSTRACT

A baseball pitching analyzer having a housing in the form of a cube with a forward face including an opening through which the baseball may pass. The periphery of this opening is angled inward to provide a funnel arrangement such that balls striking the front face will be deflected through the opening. Located within the housing is an open rectangular frame mounting a plurality of light emitters and associated light detectors, arranged to form an array or grid of intersecting light beams. The frame includes lenses spaced from the emitters and detectors to maintain a well collimated light beam. The emitters and detectors are alternated about the periphery of the frame, such that light emitters are located adjacent each of the light detectors. The associated beam for each detector is therefore less likely to impinge upon another detector, reducing crosstalk and permitting a closer grid spacing. The control system includes a timer which is started upon the blocking of a light beam and stopped upon the unblocking of a light beam. This time is used with the known diameter of a baseball to calculate the velocity of the pitch. Balls received within the device are conveyed to an elevated dispensing opening and passed out of the device, such that they may be easily received within a storage bag or pitchback device. The results of the location and speed of the pitch may be displayed by a printer and/or display unit.

4 Claims, 4 Drawing Sheets

BASEBALL PITCHING ANALYZER

BACKGROUND OF THE INVENTION

1. Field of the Invention

The present invention relates in general to sports-related training and amusement devices. In particular, the present invention relates to an improved device for measuring the speed of a pitched baseball and its location within a simulated strike zone.

2. Description of the Related Art

It has been known to provide devices which will determine the location of a pitched baseball within a simulated strike zone, with certain of these devices including arrangements to determine the speed of the pitched baseball. Such devices typically take the form of a backstop having an array of pressure sensors which sense the location of the ball where it strikes the backstop. This type of pitching analyzer typically provides reduced accuracy in determining the location of the pitch within the strike zone, as the pressure sensors must be located behind a layer of padding to protect them from impact. This padding spreads the force of the impact, making it difficult to precisely determine the point of impact. Additionally, the pressure sensors are relatively expensive and are subject to failure after repeated impacts.

It is also known to form a pitching analyzer using a square or rectangular array of light beam emitters and receivers, with the light beams forming a grid. Circuitry is employed to detect those beams of light which the baseball blocks as it passes through this grid, thus determining the location of the ball within the simulated strike zone. This second arrangement provides increased reliability, but has suffered from several other drawbacks. For example, the detectors for the light beams have suffered from crosstalk from two sources.

First, ambient lighting may be sufficiently bright that the detectors do not register when the light beams have been broken. Second, the difficulty in producing a well focused light beam across the desired distances to approximate a strike zone have resulted in detectors failing to note the blockage of their associated light beam due to impingement of light from the light beams associated with adjacent ones of the detectors. To overcome this crosstalk between adjacent light beams, it has been necessary to increase the spacing between the light beams, thus reducing the 15 accuracy of detection, or to employ relatively expensive light sources to produce sufficiently tight beams. This second problem is aggravated with increased distance between the emitter and detector, causing such devices to be limited to a grid defining a simulated strike zone only, within no detection of "balls" outside the strike zone or even to a strike zone smaller than that which would be normally encountered during normal play.

Where such light grid devices have been provided with means to determine the velocity of the object passing therethrough, this has been effected by providing two parallel light grids spaced in the direction of travel of the object. The blocking of a light beam within the first grid begins a counter which is stopped upon blocking of a light beam within the second grid. The time measured by this counter is then used with the known distance between the light grids to calculate the velocity of the object. While this arrangement is sufficiently accurate, the necessity of providing two identical light grids greatly increases the cost of the device.

SUMMARY OF THE INVENTION

An object of the present invention is to provide a device which will accurately determine the location of a pitched baseball as it passes through a simulated batting area containing a strike zone and ball zone.

Yet another object of the present invention is to provide such a device which will additionally accurately measure the velocity of the ball.

Yet another object of the present invention is to provide such as device which will convey the baseballs received therein to a convenient location for dispensing into a storage bag or pitchback device.

Yet a further object of the present invention is to provide such a device which will accurately receive baseballs pitched within a certain distance outside the perimeter of the simulated batting zone, and to provide an indication that such pitched baseball was beyond the batting zone.

Yet another object of the present invention is to provide such a device which employs a single light grid which is inexpensive, yet greatly reduces the possibility of crosstalk.

These and other objects are achieved by a baseball pitching analyzer having a housing in the general form of a cube with a forward face including an opening through which the baseball may pass. The periphery of this opening is angled inward to provide a funnel arrangement such that balls striking the front face will be deflected through the opening. Located within the housing behind the opening is an open rectangular frame mounting a plurality of light emitters and associated light detectors, arranged to form an array or grid of intersecting light beams. The frame includes lenses spaced from the emitters and detectors to maintain a well collimated light beam to increase the possible distance between the emitters and detectors, and thus increase the batting zone defined by the grid. The emitters and detectors are alternated about the periphery of the frame, such that light emitters are located adjacent each of the light detectors. The associated beam for each detector is therefore less likely to impinge upon another, unassociated, detector, reducing crosstalk and permitting a closer grid spacing. The control system includes a timer which is started upon the blocking of a light beam and stopped upon the unblocking of a light beam. This time is used with the known diameter of a baseball to calculate the velocity of the pitch. Balls received within the device are conveyed to an elevated dispensing opening and passed out of the device, such that they may be easily received within a storage bag or pitchback device. The results of the location and speed of the pitch may be displayed by a printer and/or display unit.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
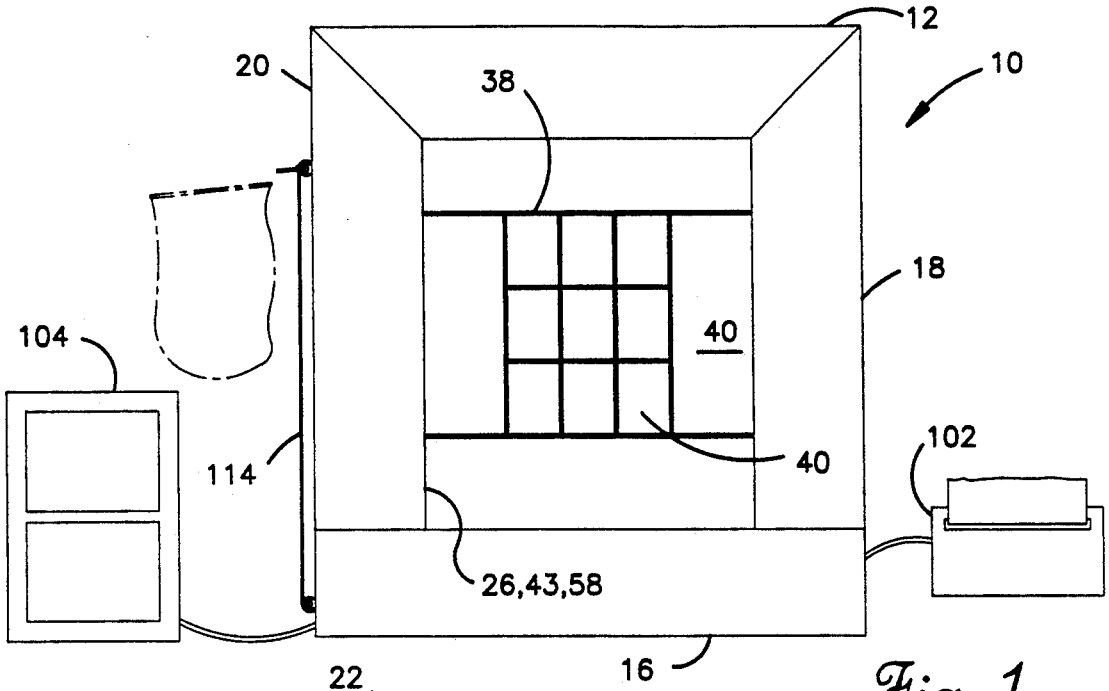
FIG. 1 is a front view of a device according to the present invention.

With reference to FIG. 1, a device according to the present invention is generally designated by reference numeral 10. The device 10 includes a main housing 12 having the general form of a cube or rectangular prism. The main housing includes top and bottom panels 14 and 16, right and left side panels 18 and 20, and front and rear panels 22 and 24. The panels 14–24 may advantageously be formed of sheet metal or aluminum which has been welded or bolted together.

The housing 12 may be supported on wheels or casters to make it more easily transportable. However, such wheels or casters should include locks such that the device 10 will not move during use, thus reducing variations in the pitching conditions. To further reduce the possibility of such movement, the device may be provided only with a pair of wheels 23 located adjacent the bottom edge of the rear panel 24. With this arrangement the device 10 would normally rest upon the bottom panel 16, thus producing a sufficient amount of friction to prevent movement. However, when it is desired to move the device it may be tilted to rest upon the wheels 23 to assist in transport. Appropriate handles could be provided on the exterior of the housing to aid in such tilting.

The panels 14–24 define an interior cavity accessible through a front housing opening 26 having a generally rectangular shape. During use, the user will pitch the baseball through this front opening into the interior cavity, such that this front opening will define the simulated batting area.

Figure 2:
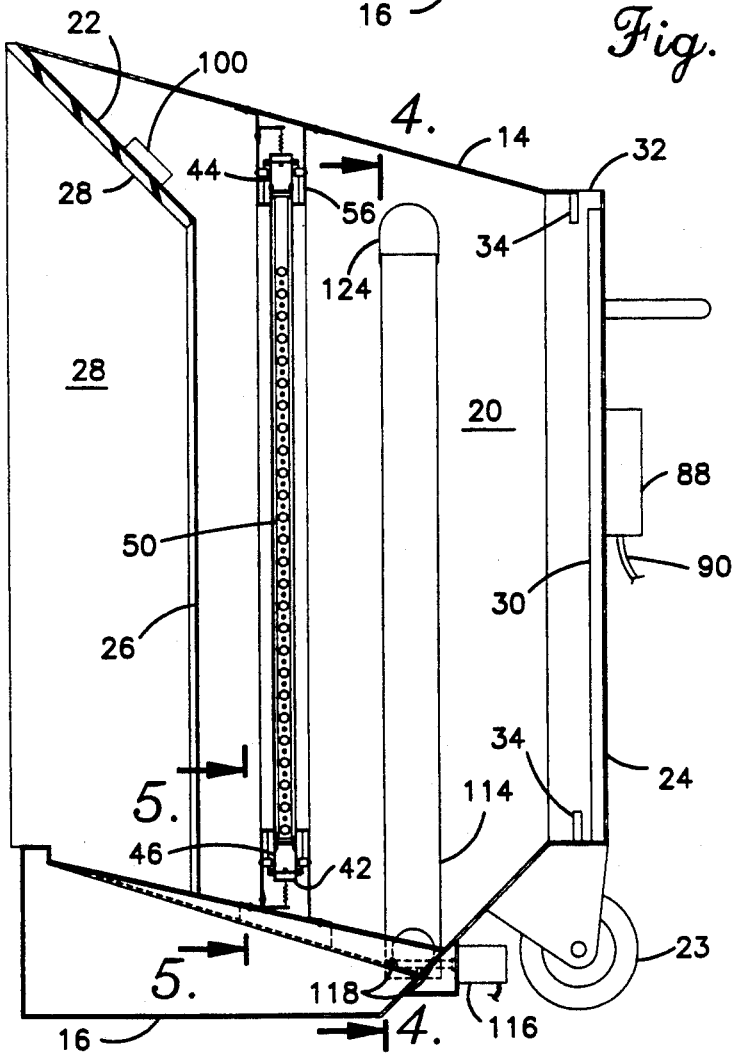
FIG. 2 is a cross-sectional side view of the device of FIG. 1.

As is shown in FIG. 2, the periphery of the opening 26 is spaced inward with respect to the outer peripheral edge of the front panel 22, such that the front panel takes the general form of a funnel directed towards the interior cavity. Mounted upon these angled portions of the front panel are one or more pads 28. The pads 28 are employed to dampen the impact of a baseball hitting the front panel 28 to reduce damage to the device 10. Where a baseball does impact upon the pads 28, however, the angled configuration of the front panel 22 will ensure that the baseball is deflected into the interior cavity, rather than bouncing outward, such that all baseballs are retained within the device 10 for disposition as described below. The particular angle of the front panel 22 with respect to horizontal may be readily determined by consideration of the relative coefficients of restitution of the pads 28 and the baseball, an the anticipated range of velocities with which the baseballs may impact the pads.

Mounted within the interior cavity and in close proximity to the rear panel 24 is a backstop cushion 30. The cushion 30 will preferably have a peripheral extent substantially corresponding to the interior face of the rear panel 24 and will be formed of a material which will dampen the impact of pitched baseballs, such that the baseballs will fall downward to be retained within the device 10, rather than bouncing back out through the opening 26.

While various materials could be employed for the cushion 30, it has been found advantageous to employ a rubber and cloth laminate of the type typically employed as a printer's blanket While the cushion 30 may be rigidly fixed within the interior cavity to the rear panel 24, it is preferred that the cushion be removable for repair or replacement.

To this end, the top panel 14 may include an elongated slot 32 in close proximity to the rear panel 24, such that the cushion 30 may be inserted and removed through this slot 32. To aid in maintaining the cushion in the substantially vertical configuration, the top, bottom, right and left side panels may include an inwardly extending lip 34, and alternatively or additionally, the cushion may be provided with appropriate straps, fastening means, stiffening elements or other members to aid in retaining it in the upright configuration. To further ensure that the baseballs do not bounce outward after impacting the cushion 30, a large portion of the rear panel 24 may be removed and a section of chain link fencing, nylon webbing or other somewhat flexible material may be inserted within such opening to increase the dampening effect of the cushion 30.

To provide further assurance that the baseball will not bounce out of the device 10 and to reduce the possibility of damage to the device, additional cushions or pads may be located upon the interior faces of the side, top and bottom panels.

As is best shown in FIG. 1, the user will face the front panel 22 during operation of the device, such that the interior face of the cushion 30 is visible through the opening 26. To provide the user with a target or goal during operation of the device, an appropriate set of indicia 36 may be provided upon this interior face of the cushion 30. The indicia 36 preferably includes at least a rectangular area 38, having a periphery equal to or smaller than that of the front opening 26, which will be designated as a strike zone. It is most preferred that the strike zone 38 be smaller than the opening 26, with the area between the opening 26 and zone 38 defining a ball zone. To provide additional challenge for the user, and aid in training pitchers, the strike zone 38 and adjacent area may be subdivided into a plurality of subzones 40. For example, the strike zone 38 may be divided into a $3\times3$ array of rectangular subzones 40. In a similar manner the ball zone located between the strike zone 38 and periphery of opening 26 could be subdivided into a top and a bottom region extending across the full extent of the opening 26 above and below the strike zone, and right and left ball zones located laterally of the strike zone 38. It should of course be apparent that other arrangements of subdivisions are possible.

It is preferred that the strike zone 38 have a size approximately equal to that normally encountered with a batter in position to provide the greatest assistance in training pitchers. However, the device 10 could be used for amusement purposes, and include various sizes and shapes of targets, one or more of which are strike zones or subzones. The strike zone, and preferably the subzones, are provided with distinctive coloration or colored outlines such that a user at a normal pitching distance may readily discern the various subzones 40.

The device 10 also includes means for detecting passage of the ball, and in particular, means for detecting the location and speed of the ball as it passes through the interior cavity. This means includes a sensor frame 42 having the general configuration of an open rectangle with a sensor frame opening 43 surrounded, and defined, by top and bottom bars 44 and 46, and right and left bars 48 and 50. These bars will mount a plurality of light emitters 52 and light detectors 54, described in more detail below, with these elements arranged such that the light beams from the emitters 52 will extend across the opening 43 in the form of an array or grid. As is known in the art, the passage of the ball through this open area will block the light beams, with this blockage being detected by the detectors 54.

Due to the relatively delicate nature of the emitters and detectors, the sensor frame 42 is housed within a pair of sensor guards 56. The sensor guards take the general form of an open rectangle, similar to the sensor frame 42, with each of the guards having a guard opening 58 therethrough, with these openings substantially aligned with each another and the guards being spaced in the direction of travel of the baseball. One or both of the guards are fixed to one or more of the panels 14–20 in the interior cavity. To reduce the possibility of impact of the baseball against the guards 56, it is preferred that the opening of the guards and the front opening 26 be relatively sized such that the front opening 26 has a periphery slightly smaller than that of the opening through the sensor guards. This will help to ensure that the baseballs will hit the front panel 22, and in particular the pads 28 thereon, rather than the guards 56.

As noted above, the guards 56 are spaced in the direction of travel of the baseball. Located intermediate the guards is the sensor frame 42. The sensor opening 43 preferably has a periphery slightly greater than that of the guard opening 58, such that the sensor frame 42 is slightly recessed within the sensor guards 56. To provide further safety for the sensor frame, the sensor frame may be suspended between the guards 56 by one or more springs 62 extending peripherally outward from each of the bars 44 through 50, with the springs being connected to the associated panels 14–20 or to portions of one or more of the guards 56 extending about the periphery of the sensor frame 42. By forming the sensor frame with an outer periphery smaller than that of the housing 14, and a depth in the direction of travel of the baseball smaller than that of the spacing between the guards 56, the sensor frame is substantially isolated and protected against the possibility of impact by a baseball. To further eliminate the possibility of damaging shock to the sensor frame, resilient bumpers 82 may be mounted on the interior of the guards 56 to dampen the impact should the sensor frame be moved toward one of the guards by impact with the ball or during transport.

To further reduce the possibility of such an impact, the periphery of the guard openings 56 may include a horizontally directed lip 60, with the lip 60 of each guard 56 extending towards the other of the guards 56, in a covering relation about the sensor frame 42. While the lips 60 will extend into the sensor opening 43 of the sensor frame, the free ends of the lips 60 preferably are spaced a sufficient distance so as not to interfere with the operation of the emitters and detectors 52 and 54. Additionally, it is possible to form the spacing between the free ends of the lips 60, together with the recess distance of the sensor frame from these lips, such that a standard baseball, when engaged against the free ends of the lips 60, will not extend inward of the guards 56 a sufficient distance to actually contact the sensor frame 42.

Figure 3:
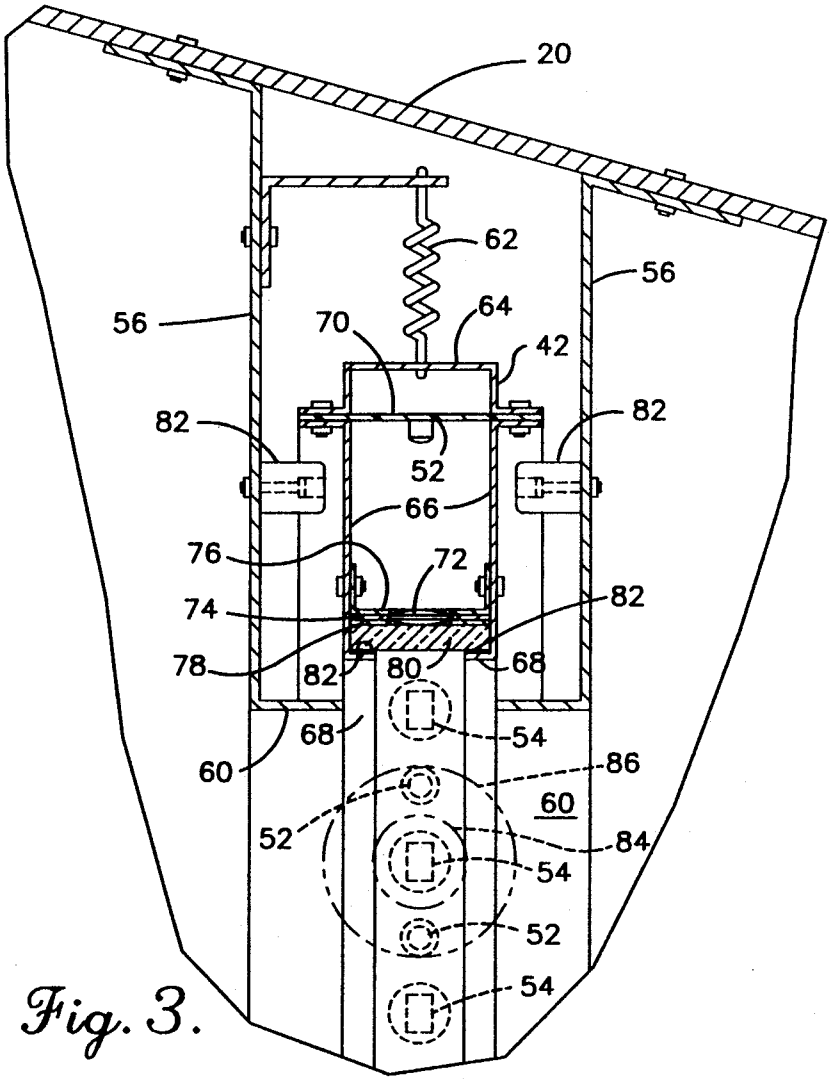
FIG. 3 is a cross-sectional view showing details of a light grid frame according to the present invention.

With reference to FIG. 3, the details of the sensor frame 42 are shown. The elements of each of the bars 44–50 are common, and as such only the left bar 50 will be described.

The bar 50 includes at its outer periphery an edge plate 64 from which the springs 62 extend to their fixing point on the guards 56. Edge plate 64 includes a pair of flanges spaced in the direction of travel of the ball (the longitudinal direction) and to each of these flanges is mounted a peripherally inward extending side plate 66. As such, the side plates are spaced in the longitudinal direction. In a manner similar to the guard lips 60, each of the side plates includes a mounting lip 68 extending in the longitudinal direction towards the other of the side plates 66. The edge plate 64, side plates 66, and mounting lip 68 therefore define an open cavity within which the sensor elements are mounted.

Specifically, light emitters 52 and detectors 54 are housed between the edge and side plates 64 and 66 and are directed towards the opening defined by the free ends of the mounting lips 68. The emitters and detectors may be of any variety which will accurately and reliably form a beam of light, the blockage of which may be detected. For example, the emitters could be formed by lasers, LEDs, or other elements. In the present embodiment, it is preferred to form the emitters 52 as infrared (IR) LEDs. This may be advantageously effected by forming the emitters and detectors upon printed circuit boards 70, and sandwiching these printed circuit boards between the flanges of the edge plate and the side plates.

Where light sources are employed which are not coherent, the beam of light produced by each emitter will tend to spread out in a cone and cover a large area once the beam has travelled any appreciable distance, such as the distance from the top bar to the bottom bar of the sensor frame. As such, it is necessary to provide a focusing means for such light beams.

This focusing means may take the form of a lens 72 mounted adjacent the opening between the lips 68. The lens 72 may be held in position by a central lens plate 74 having an opening therein which may closely receive the outer periphery of the lens. To maintain the lens within the opening in the central lens plate, there are provided first and second outer lens plates 76 and 78. Each of these lens plates includes an opening which is at least substantially coaxial with that in the central lens plate 74, and which has a smaller periphery, such that the lens 72 may not pass through the opening in the plates 76 and 78. By sandwiching the central lens plate between the outer lens plates, the lens 72 will thus be securely maintained in the proper position.

To maintain the lens plates in their stacked or sandwiched configuration, the second outer lens plate 78 may abut against the mounting lips 68, and the first outer lens plate may be fixed to the side plates 66, as by providing appropriate flanges at its longitudinal ends, and fixing these flanges to the side plates by means of screws or bolts. As an additional safety feature, there may be a layer 80 of safety glass interposed between the second outer plate 78 and the mounting lips 68. This will help to shield the lens 72 against possible impact. Additionally, to provide protection against the elements, there may be mounted seals 82 between the glass 80 and mounting lips 68.

This lens mounting arrangement is believed to be advantageous, as the lens plates 74–78 and side plates 66 may be formed on a numerical control punch which allows a sufficiently high accuracy to assure proper lens placement, yet which is economical to reduce the cost of the device.

As is well known in the art, there will be provided a plurality of the emitters and detectors on the bars 44 through 50, and as such the lens plates will extend substantially the entire distance of each bar, and include a plurality of holes to mount plural lenses 72. The emitters 52 and associated lenses 72 will be mounted such that the light beam produced by these elements will extend substantially perpendicular to the longitudinal direction, thus forming a plurality of horizontal light beams and a plurality of vertical light beams to define the grid. The lenses 72 will thus have an appropriate shape to focus the beam produced by its associated emitter to maintain the beam in a tight configuration across the length of the opening 43, and similar lenses may be mounted above each of the detectors 54 to provide a final focusing of the light beam onto the emitter mounted upon the printed circuit board 70.

An important aspect of the present invention is the arrangement of the emitters 52 and detectors 54 in an alternating pattern along each of the bars 44–50. Specifically, rather than mounting only emitters upon the top bar 44 and only associated detectors 54 along the bottom bar 46, the emitters and detectors are alternated along each of the bars. As should be apparent, the pattern of alternation is opposite for oppositely facing bars, such that if the leftmost element of the top bar is an emitter, the leftmost on the bottom bar is an associated detector.

By providing the emitters and the detectors in an alternating relationship, the possibility of crosstalk between detectors is substantially reduced. As illustrated by the double dashed line circle 84, where the detectors are placed adjacent each other, the beam of light associated with a single detector must be sufficiently focused such that it does not impinge upon the immediately adjacent detectors. However, in the alternating relationship of the present invention, the immediately adjacent elements for each detector are emitters. Since there will be no error produced by a beam of light impinging upon an emitter, the beams of light produced in the present invention need only be sufficiently focused such that they are within the double dashed line circle 86.

This provides several advantageous consequences. First, since the detectors need not be spaced from each other solely to avoid activation by light beams with which they are not associated, i.e. to reduce crosstalk, the emitters and detectors may be spaced closely together. As illustrated in FIG. 3, the alternating emitters and detectors may be spaced as close together as the lenses 72 and lens mounting arrangement permits, so long as crosstalk is avoided. This close spacing of the light beam in turn allows a more precise determination of the location of the baseball as it passes through the sensor opening 43, and of the speed of the baseball, as discussed below.

A further advantage is that for a sensor frame of given size, the alternating arrangement of the present invention will allow the use of less precise, and therefore less expensive, lenses 72. Conversely, for a given lens arrangement, the size of the sensor opening 43 may be increased when the present alternating arrangement is employed, as this arrangement allows a larger diameter light beam, such as would be encountered in a light beam traveling across a larger sensor opening.

Each of the emitters and detectors are connected to an appropriate power supply as needed, and the detectors 54 are operatively connected to a control system. This control system preferably takes the form of electronic components mounted within a control box 88 on the rear panel 24 of the housing (FIG. 2). The control box and electronic components will be connected to an appropriate power supply by a cable 90.

Figure 6:
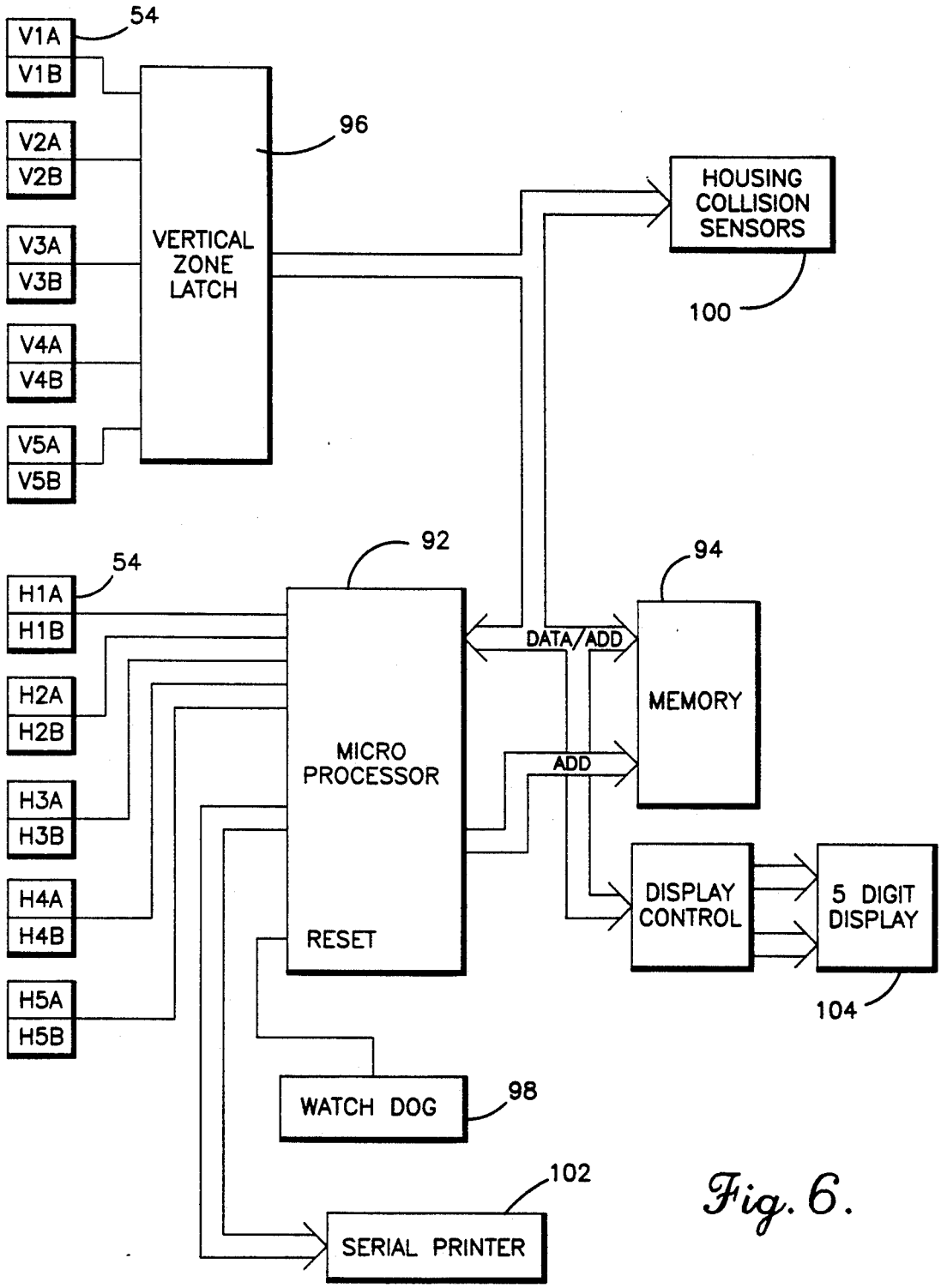
FIG. 6 is a block diagram showing the electrical components of the present device.

A block diagram illustrating the control means for the present device is illustrated in FIG. 6. This control means may include a microprocessor 92 connected with a memory 94, such as a PROM, such that the microprocessor may store and retrieve values to carry out its operational program. As is known in the art, the detectors 54 will provide signals to the microprocessor, such that the microprocessor may determine the particular location or zone of the opening 43 through which the baseball has passed, by comparing the signals from those detectors receiving horizontal beams of light and those detectors receiving vertical beams of light.

While it is possible to operatively connect the microprocessor with each one of the detectors, such that the microprocessor will have access to information indicating those particular ones of the detectors which have detected a block in the light beam, it is preferred that the detectors be segregated such that the microprocessor directly receives the signal from only one of the horizontal or vertical groups of detectors, and in the example show this group is the horizontal group. Even within this group it is preferred to divide the detectors into plural sets each having plural detectors associated therewith, and the communication lines from all detectors within a particular set being combined such that the microprocessor will receive signals only from the sets, and not individual detectors.

These sets preferably correspond to the various zones where such have been defined, and as such for the present invention there would be five such sets. In particular, the subzones 40 include, in each of the horizontal and vertical directions, three subzones within the strike zone 38 and two subzones bounding the strike zone. In this example, in the subzone which is vertically above the strike zone 38, all of the detectors 54 within this area mounted upon the right bar 48 may be designated detectors H1A, while the all the detectors within this area mounted upon the left bar 50 may be designated as detectors H1B. The signals from detectors H1A and H1B will be combined as a single input for the microprocessor 92. This arrangement allows the use of a small microprocessor having a much lesser number of input pins.

As the baseball passes through the sensor opening 43 it will block both vertical and horizontal light beams, thus causing a signal to be generated by both a horizontal and a vertical set of the detectors. The speed of microprocessor 92 would allow it to determine which of the horizontal sets is providing a signal and store a value representing this set and thereafter determine which vertical set is sending a signal and store a value representing this set during the time it takes the ball to pass through the light grid, i.e. while the light beams are still blocked. However, as is described in more detail below, the microprocessor 92 is performing other acts during the passage of the ball through the light grid. As such, it is preferred that the sets of vertical detectors are placed in communication with a vertical zone latch 96 which will act as a buffer to the microprocessor 92 and will store the first of the signals received from one of the vertical detector sets.

The control system also includes a watchdog 98 which monitors the operation of the microprocessor and will provide an automatic reset should the system "lockup" or experience other difficulties as is known in the art.

The microprocessor 92 may also have input from housing collision sensors 100. With reference to FIG. 2, one or more sensors 100, in the form of motion detectors, may be mounted upon the interior face of the front panel 22. The sensors will provide a signal should the baseball strike the pads 28. This may be necessary due to the angled configuration of the front panel which allows baseballs striking the front panel to enter the interior chamber of the device. When such baseballs enter the chamber there is a strong possibility that these baseballs will pass through the sensor opening 43 and thus be detected by the device. As the direction and speed of the baseball will be seriously altered by impact with the pads 28, the provision of the collision sensors permits an indication of such a collision, such that the information on speed and location of the thrown baseball generated due to the baseball passing through the sensor frame may be disregarded.

As the microprocessor 92 will calculate information regarding the baseball as it passes through the sensor frame, the device 10 includes various means to convey this information to the user. For example, the device 10 may include a printer 102 in communication with the microprocessor 92. The printer may be of any well known type, but is preferably a serial receipt printer having a single cable which carries both the communication and power lines. The device 10 may also include a display board 104 to provide an immediate indication to the user of the information generated by the microprocessor 92. The display board is preferably of the type employing magnetic vane character generators, as such generators require power only to change the display, and not to maintain it.

Figure 7:
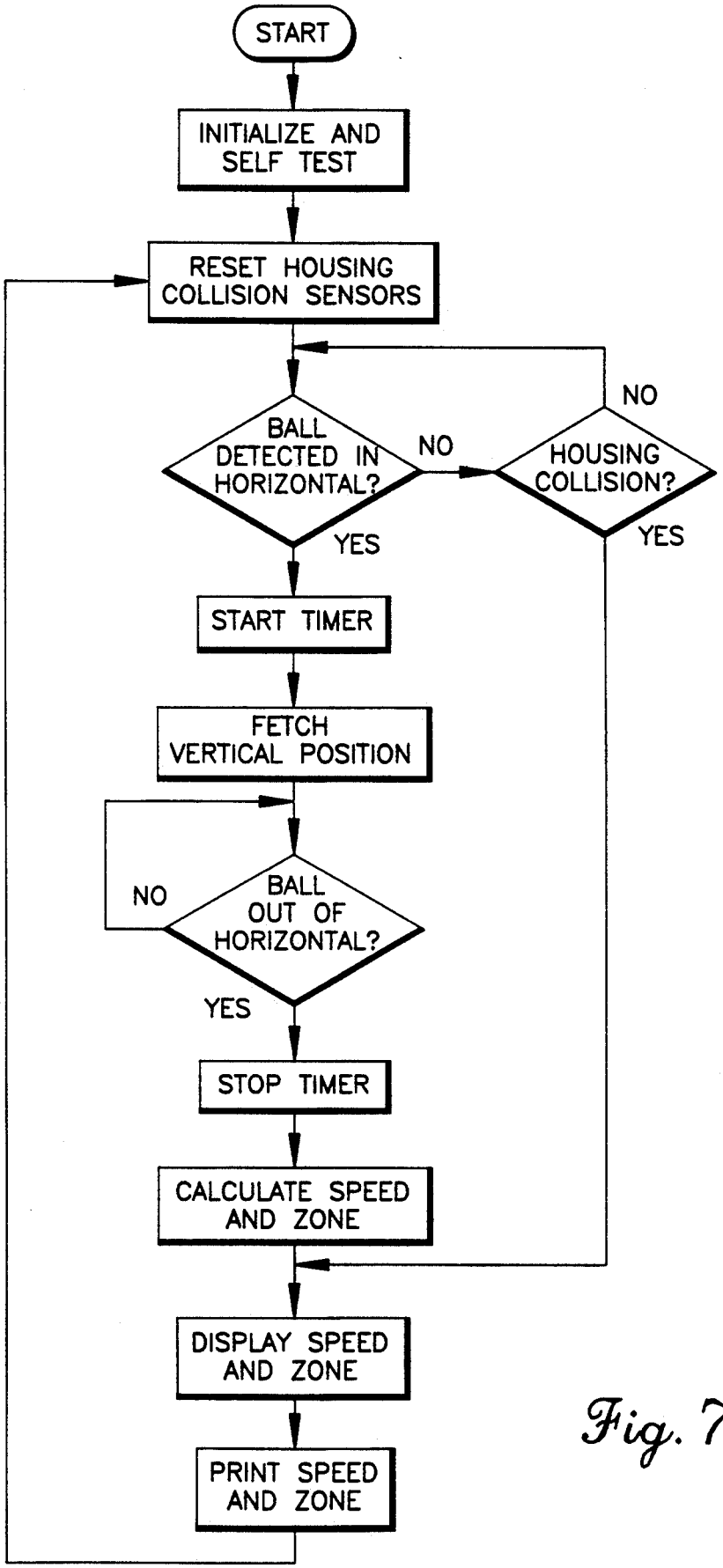
FIG. 7 is a flow chart showing program operation of the present device.

The operational sequence of the program carried out by microprocessor 92 will now be described with reference to FIG. 7. Upon starting, the program will cause the microprocessor and associated elements to initialize and perform a self-test. Thereafter the program will begin its main loop, first resetting the collision sensors 100. At this point, the microprocessor will await a signal from one of the sets of horizontal detectors. If no passage of the baseball has been detected by the horizontal detectors the program will then cause the microprocessor to check for activation of the collision sensors 100. If a collision sensor has been activated by impact of the baseball, the program will jump to the output section, where it will display and/or print a record indicating that the pitch in question included a collision with the housing.

If no signal has been received from the collision sensors 100, the program will loop back to check once again for a signal from the horizontal detectors, and will thereafter continue to alternate between the collision sensors and the horizontal detectors until a signal is received. When such a signal is finally received, the microprocessor will immediately begin operation of a timer. Thereafter, the microprocessor will interrogate the vertical zone latch 96 to determine which of the vertical sets of detectors provided a signal. Information corresponding to the vertical and horizontal set which has detected the baseball will then be stored within the memory 94. At this point, the program will enter into a loop to wait for the sets of horizontal detectors to provide a signal that the baseball has passed through the light grid and the horizontal detectors are no longer blocked. When this occurs, the microprocessor immediately stops the timer and stores this value. The microprocessor then employs the vertical and horizontal zone information to determine which of the subzones 40 the baseball was positioned in during its passage through the light grid in the sensor opening.

The determination of the position of the baseball may be made by the microprocessor simply looking up a designation within an array having rows and columns corresponding to the detector sets. Due to the use of only the first detector set signal received in both the horizontal and vertical directions, and due to the small grid spacing allowed by the alternating detector arrangement, it is very unlikely that two set signals from a single direction would be received simultaneously. However, the program may include appropriate steps to choose between the two signals.

In addition to baseball position, the microprocessor takes the information from the timer and performs calculations using this information to determine the speed at which the baseball was traveling. Specifically, the program will divide the known diameter of a baseball by the observed time from the timer to calculate a velocity for the baseball. When these steps have been completed the program will move to the output section and will print and/or display the subzone number and speed of the pitch, possibly with additional identifying information, such as a pitch number.

As should be apparent from the above description of the structure of the sensors and the operation of the microprocessor, the device according to the present invention allows the velocity of the baseball to be determined with use of only a single light grid, rather than longitudinally spaced parallel light grids as in the prior art. This is an important aspect of the present invention. While such a single grid velocity calculation would be possible using prior art emitter and detector arrangements, the alternating positions of the emitters and detectors in the present invention provide increased accuracy in the velocity calculation.

Specifically, baseballs passing through the light grid will first contact the plane of the grid at a point location on the outer surface of the baseball. This point location may be directly centered upon a light beam, in which case the sensor arrangement is irrelevant as to accuracy. However, where this point location is positioned between two adjacent beams, the baseball will travel a slight distance through the plane of the grid before a detector is triggered. Similarly, as the baseball exits from the plane of the grid, where the baseball is between beams, the adjacent beams will be unblocked while a small portion of the baseball is still within the plane of the grid. As such, the time observed by the detectors for the baseball passing through the grid will be less than the actual time required for the baseball to pass through the plane of the grid. This inaccuracy in the timing will result in inaccuracy in the speed calculation.

To reduce this inaccuracy the spacing between the beams should be reduced as much as possible. The present arrangement of alternating emitters and detectors according to the present invention allows a simple and inexpensive method to provide a very tight spacing between the beams, and thus improve the accuracy of the timing and speed calculations. Since this reduced spacing between adjacent beams provides a sufficiently accurate calculation of the speed of the baseball (it is the inventors' belief that the present system is more accurate than the "radar guns" presently employed during baseball play to detect the velocity of the baseball) it is unnecessary to provide a second light grid as in the prior art, thus reducing the weight and cost of the present device.

While it is believed that the present arrangement is more accurate than currently employed "radar guns" for determining velocity, the present device measures velocity near the end of the baseball's flight, whereas the "radar gun" typically measures the velocity near the beginning of flight. As the velocity of the baseball is reduced by aerodynamic drag during flight, this difference could result in systematic variances between reported speeds, with the speed reported by the present device being lower than that to which the user is accustomed. To eliminate this the program could increase the initially calculated velocity by an amount based upon expected drag to produce an estimate of velocity at the beginning of the flight.

Figure 4:
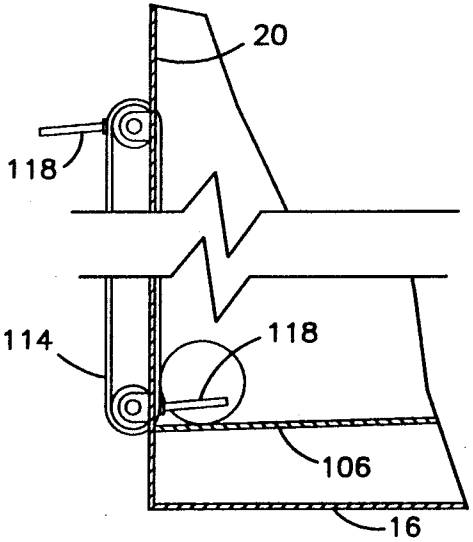
FIG. 4 is a detail view showing the details of the floor of the present device.

After the baseball has passed through the opening 43 it will impact upon the backstop cushion 30 and fall downward to rest within the interior cavity of the device. As is known in the art, the interior cavity may be provided with a floor 106 formed as a plane tilted in two directions such that the baseball will roll towards the lowest corner to be retained therein or pass through an opening in the housing. As shown in FIG. 4, in such an arrangement the lower portion of the guards for the sensor frame will have an appropriate configuration to follow the contour of the floor, and will include a cutout portion 108 to allow passage of the ball from in front of the guards to behind the guards.

Alternatively, a floor configuration more complex than that normally employed could be used. Specifically, it is preferred that the sensor frame 42 be located at a position spaced inwardly from the front housing opening 26, and preferably at the midpoint between the opening 26 and the backstop cushion 30. By spacing the sensor frame from the opening, the amount of ambient exterior light which impinges upon the detectors 54 will be reduced. This will reduce or eliminate the possibility of a faulty detection (and in particular a lack of detection). However, the sensor frame 42 and associated sensor guards 56 may extend downward a sufficient distance such that a baseball will not pass between the bottom of the sensor frame or guard 56 and the floor 106.

Where the sensor frame and guard extend downward to be fixed to the floor 106 or bottom panel 16, the floor 106 preferably will include a forward trough located between the front panel and the sensor frame and a rearward trough located between the sensor frame and backstop cushion 30. Each of the troughs will take the form of a channel extending between the right and left sides 18 and 20. The troughs will both slope downward towards one of the right or left side panels such that a baseball located in either trough will be channeled towards the center of the trough and towards a common side panel.

Both of the troughs will open onto an incline portion which runs parallel to one of the right or left side panels 18 or 20. The incline portion will have a width slightly greater than the diameter of a baseball and will have a continuous incline towards a lower end, which may be located at a center line of one of the troughs, for example rearward trough. As such, baseballs exiting from the trough will be caused to roll down the incline portion to a particular location, which may be adjacent to a dispensing hole extending through the side panel, such that the baseball will roll out of the main housing 12.

Figure 5:
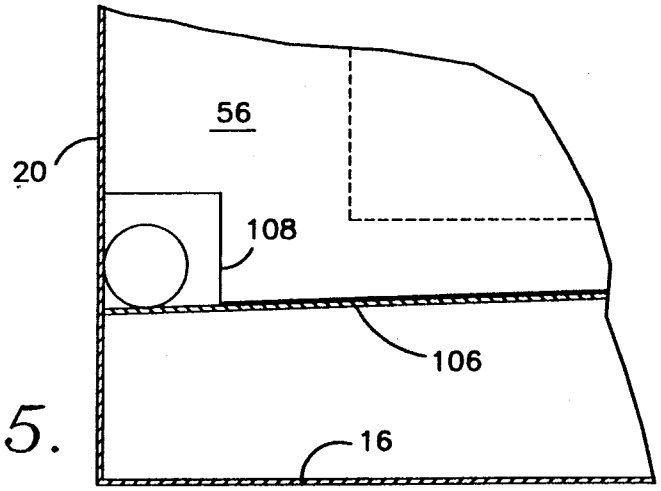
FIG. 5 is a detail view showing details of an elevator conveyor according to the present invention.

A preferred arrangement for removing the baseballs from the interior of the housing is shown in FIG. 5. This figure shows a conveying and dispensing means to cause the baseballs to exit from the housing at a position on the side panel spaced upwardly from the bottom panel 16. In particular, an elevator mechanism including a pair of vertically spaced pulleys about which is mounted an endless belt 114 may be mounted to the interior face of the side panel. One of the pulleys will be connected to a motor 116 which will drive the belt about the pulleys. The belt 114 will mount a pair of lifting fingers 118 which extend outward and are sized and shaped such that they will support a baseball from below. While a single pair of fingers 118 could be provided, it is also possible to provide two sets of fingers 118, spaced at equal distances along the belt 114. The belt and pulleys will be arranged such that the fingers 118 may pass upwardly through corresponding finger slots (not shown) formed through the floor 106 at the lower end of the incline portion 112.

Adjacent the upper end of the belt 114 there could be provided a guide ramp which extends between the belt 114 and a discharge opening 124 in the side panel. The guide ramp would include finger slots such that the fingers 118 may could pass through the ramp during rotation of the belt about pulleys.

Alternatively, the pulleys could be located such that the fingers are located outside the housing at their upper end, such that the guide ramp could be eliminated. In such a situation the ball would simply fall from the fingers outside the housing.

With this arrangement located within the interior of the housing, the baseball will be caused by the troughs to move towards a side panel, and then move along the inclined portion to a position intermediate the fingers 118. At this point activation of the motor 116 will cause the belt to move, lifting the fingers 118. The fingers will support the baseball from below and lift it upwardly and deposit it upon the guide ramp 122. From there the baseball will roll down the guide ramp 122 and out of the opening 124. Once the baseball has been deposited the motor 116 will move the belt to place the fingers in a rest position, preferably that shown in FIG. 5 with the fingers 118 located just below the upper surface of the floor 106, such that the they may readily receive the next baseball. It is also possible to provide a connection between the motor 116 and the microprocessor 92 such that the microprocessor will automatically activate the motor 116 for the proper amount of time after a baseball has been sensed passing through the light grid.

With this arrangement the dispensing of the baseball is from the discharge opening located above ground level. As such, a baseball storage bag may be located just below the opening 124 on the exterior of the housing, or adjacent the housing, such that the baseballs will be automatically deposited within the storage bag. Alternatively, a pitching machine could be used with or incorporated into the present device, such that baseballs exiting the discharge opening will be fed to a hopper of the pitching machine. With this arrangement, the baseball which the user has pitched into the device will be automatically pitched back to the user to be thrown again.

While the present invention has been described above with regard to baseballs and pitching, it is to be understood that the present device could be employed with softballs, bullets, beanbags, or other objects.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. In a pitching analyzer including a sensor frame having a central opening which an object to be detected will pass through, a plurality of light emitters directed across said central opening to define a light grid substantially normal to an anticipated flight path for the object, and a light detector associated with each of said emitters and located at a position substantially opposite to its associated one of said emitters with respect to said opening, the improvement comprising:

a housing defining an interior cavity and including a front panel having an opening extending therethrough for passage of the object to be detected, said front panel having a funnel configuration about at least a portion of its extent such that at least a portion of the periphery of said opening is located a predetermined distance from the largest peripheral dimension of said funnel configuration, whereby the objects to be detected will be deflected through said opening at the smallest peripheral dimension of said funnel configuration upon impact with said portion of said extent of said front panel, said housing further including a back wall upon which the objects will impact after passing through said opening;

said sensor frame being resiliently mounted to said housing within said cavity at a position intermediate said front panel and said back wall, with said central opening of said sensor frame being substantially aligned with said front panel opening, said sensor frame including a single one of said light grids;

a sensor guard mounted to said housing within said cavity in proximity to said sensor frame and having at least a portion intermediate said sensor frame and said front panel, said sensor guard portion having an outer peripheral extent greater than that of said sensor frame to thereby extend peripherally outward of said sensor frame, and a sensor guard opening substantially coaxial to, and having a smaller peripheral length than, said opening of said sensor frame, whereby said sensor guard opening extends peripherally inward of said opening of said sensor frame; and further including control means operatively connected to said detectors, said control means including a timer, memory and calculation means, said control means activating said timer during the period the object passes through the light grid, as detected by said detectors, and said calculating means automatically calculates a velocity of the object by dividing the known size of the object, stored in said memory, by the output of said timer.

2. The improvement of claim 1, further comprising:

said emitters and detectors being arranged in an alternating relationship in the peripheral direction about said opening.

3. The improvement of claim 1, further comprising:

means for conveying the object from within said cavity through an opening in said housing at a position spaced from the ground, whereby a receptacle for an object may be placed below said opening.

4. The improvement of claim 1, further comprising:

another substantially identical sensor guard portion located intermediate said sensor frame and said back wall.

* * * * *